US010805729B2

(12) United States Patent
Lam et al.

(10) Patent No.: US 10,805,729 B2
(45) **Date of Patent: *Oct. 13, 2020**

(54) SYSTEM AND METHOD FOR CREATING CROSSTALK CANCELED ZONES IN AUDIO PLAYBACK

(71) Applicants: Wai-Shan Lam, Hong Kong (HK); Daniel Weiss, Uster (CH); Scuola universitaria professionale della Svizzera italiana (SUPSI), Manno (CH)

(72) Inventors: Wai-Shan Lam, Hong Kong (HK); Daniel Weiss, Uster (CH); Tiziano Leidi, Dino (CH); Alberto Vancheri, Bellinzona (CH)

(73) Assignees: Wai-Shan Lam, Hong Kong (HK); Daniel Weiss, Uster (CH); Scuola universitaria professionale della Svizzera italiana (SUPSI), Manno (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/733,471

(22) Filed: Jan. 3, 2020

(65) Prior Publication Data

US 2020/0145755 A1 May 7, 2020

Related U.S. Application Data

(63) Continuation-in-part of application No. 16/157,330, filed on Oct. 11, 2018, now Pat. No. 10,531,218.

(51) Int. Cl.
*H04S 7/00* (2006.01)
*H04R 3/00* (2006.01)
(Continued)

(52) U.S. Cl.
CPC ..... *H04R 3/14* (2013.01); *H04R 5/033* (2013.01); *H04R 5/04* (2013.01); *H04S 1/007* (2013.01); *H04S 7/304* (2013.01)

(58) Field of Classification Search
CPC . H04R 3/00; H04R 3/005; H04R 3/12; H04R 3/14; H04R 1/00; H04R 1/10;
(Continued)

(56) References Cited

U.S. PATENT DOCUMENTS 9,392,367 B2 * 7/2016 Tanaka ..... H04R 3/12
9,930,447 B1 * 3/2018 Termeulen ..... G10L 21/028
(Continued)

OTHER PUBLICATIONS

Irwansyah al. et., "Estimation of Cross-Talk Compensation Filter Using Bone Conduction Ear Microphone", Proceedings of the 23rd International Congress on Acoustics, Sep. 13, 2019, pp. 7232-7238, Germany.

*Primary Examiner* — Thang V Tran
(74) *Attorney, Agent, or Firm* — Idea Intellectual Limited; Margaret A. Burke; Sam T. Yip

(57) ABSTRACT

A system of crosstalk cancelled zone creation in audio playback comprising: main transducers emitting stereo soundwaves of an audio playback; a local system comprising at least two or more close-proximity-transducers (CPTs), each is arranged proximal to one of left and right-side ear canals of a listener. Each of the CPTs comprises: a position tracking device for tracking the relative positions of the main transducers to the CPT and the other CPTs; a control unit for receiving the relative position data from the position tracking device and generating control signal according to the relative position data for the generation of crosstalk cancellation (XTC) soundwaves. Each of the CPTs is configured to generate XTC soundwaves corresponding to the stereo soundwaves arriving at the corresponding ear of the
(Continued)

listener. The generated XTC soundwaves are synchronized with the audio playback and with respect to the relative positions.

10 Claims, 8 Drawing Sheets

(51) Int. Cl.

| | |
|---|---|
| ***H04R 5/00*** | (2006.01) |
| ***H04R 3/14*** | (2006.01) |
| ***H04R 5/033*** | (2006.01) |
| ***H04R 5/04*** | (2006.01) |
| ***H04S 1/00*** | (2006.01) |

(58) Field of Classification Search
CPC ..... H04R 1/1083; H04R 5/00; H04R 5/033; H04R 5/04; H04S 7/00; H04S 7/30; H04S 7/302; H04S 7/304; H04S 1/005; H04S 1/007; H04S 2400/01; H04S 2400/11; H04S 2420/01
See application file for complete search history.

(56) References Cited

U.S. PATENT DOCUMENTS

| | | | | |
|---|---|---|---|---|
| 10,531,218 | B2 * | 1/2020 | Lam | H04R 3/14 |
| 2004/0076301 | A1 * | 4/2004 | Algazi | H04S 7/304 381/17 |
| 2006/0045294 | A1 * | 3/2006 | Smyth | H04S 7/304 381/309 |
| 2006/0050908 | A1 * | 3/2006 | Shteyn | H04S 7/30 381/309 |
| 2010/0290636 | A1 * | 11/2010 | Mao | H04S 7/304 381/74 |
| 2011/0286614 | A1 * | 11/2011 | Hess | H04S 7/303 381/302 |
| 2011/0299707 | A1 * | 12/2011 | Meyer | H04S 7/304 381/310 |
| 2014/0064493 | A1 * | 3/2014 | Kim | H04S 1/00 381/17 |
| 2014/0270225 | A1 * | 9/2014 | Gether | G10K 11/178 381/71.6 |
| 2015/0208166 | A1 * | 7/2015 | Raghuvanshi | H04R 3/002 381/71.6 |
| 2017/0374466 | A1 * | 12/2017 | Pham | H04R 5/033 |

* cited by examiner

FIG. 1 —Prior Art—

FIG. 2 —Prior Art—

FIG. 3 –Prior Art–

SYSTEM AND METHOD FOR CREATING CROSSTALK CANCELED ZONES IN AUDIO PLAYBACK

CROSS-REFERENCE WITH RELATED APPLICATION(S)

The present application is a Continuation-in-part application of U.S. Non-provisional Utility patent application Ser. No. 16/157,330 filed Oct. 11, 2018, the disclosure of which is incorporated herein by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

This invention generally pertains to the field of reproduction of 3D realistic sound, and particularly to crosstalk cancellation (XTC) methods and systems.

BACKGROUND

Normal humans are able to hear and localize sounds coming from all directions and distances because the soundwaves reaching the left and right ears each on one side of a human head have time delays, which are known as Interaural Time Differences (ITDs), and/or volume differences, which are known as Interaural Level Differences (ILDs). The brain can interpret and determine the sound spatial origin with these auditory cues and perceive sound in three-dimensions (3D).

Based on this concept, binaural recording of sound uses two microphones arranged in way mimicking a pair of normal human left and right ears to generate a sound recording embedded with 3D audio cues with the intent to create a 3D audio experience for the listener of the playback of the sound recording (also known as "dummy head recording"). The problem, however, is in the playback or reproduction of the 3D audio recording using commonly available stereo transducers. Even when the recorded left and right audio channel signals are playback separately from the left and right transducers respectively, the soundwaves corresponding to the left audio channel signal cannot be assured to reach only the listener's left ear, and vice versa for the right audio channel signal. As the time delay and/or volume differences information recorded with the original sound cannot be reproduced perfectly at the listener's left and right ears the listener cannot experience the 3D sound effect. This phenomenon is called crosstalk. FIG. 1 illustrates this crosstalk phenomenon.

A number of existing techniques have been proposed to cancel this crosstalk so to reproduce an uncorrupted 3D audio experience for a listener. Crosstalk Cancellation (XTC) can be achieved by playing back binaural material over speakers (BAL) or headphones (BAH). Most of the BAL techniques involve effecting XTC by manipulating the time domain and/or audio frequency spectrum of the input audio signals, essentially creating a XTC filter. The audio frequency spectrum manipulation can be done by adjusting variables of the XTC filter to match the response of a sound reproduction system, which includes a pair of transducers, the room within which the reproduction is made, the location of the listener in the room, and in some cases even the size and shape of the listener's head. In some implementations, the adjustment is done automatically by first measuring the response of the sound reproduction system. Then, using the inversion of this system response to convolve with the input audio signals to the transducers to remove the system response. FIG. 2 provides a simplified illustration of the working of the XTC filter in a sound reproduction system.

The biggest challenge with BAL is the influence of the listening room. Early reflections and reflections in general, will all deteriorate the level of crosstalk cancellation that an XTC algorithm can achieve in real life. One can try to mitigate the issue of reflections by either deadening the room with broadband absorbers, or using speakers with a narrow dispersion pattern (significant level drop-off off-axis). In many real-life implementations, neither solution is practical. Then there is the problem of a single sweet spot. Even though XTC can be used in combination with listener head-tracking, it is essentially still a single sweet spot. There is really no freedom of movement for the listener to speak of. Multiple XTC sweet spots is possible by using Phase Array or beam forming techniques, but the design becomes extremely complex and very costly to implement. Such system may be able to provide a few sweet spots, but not feasible in an environment such as a movie theatre.

The BAH techniques involve a general or individualized Head Related Transfer Function (HRTF) being convolved with the audio signal in order to trick the human brain into perceiving sound in 3D. However, the 3D sound experience in BAH is still not as convincing as BAL. Visual cues are often necessary as aid to trick the brain into believing that the sound is in true 3D. The effect generated by BAH techniques ultimately lack the 'physicality' of sound that one can experience with BAL. BAH is also extremely difficult to implement due to the highly individualized HRTF.

FIG. 3 illustrates an exemplary embodiment of a sound reproduction system with XTC filter. However, one common drawback of these XTC techniques in practice is that they require the listener to be at a single location that is unobstructed from the transducers (sweet-spot) and remain stationary, or the location of the listener must be known to or tracked by the system throughout the whole audio playback in order to achieve the ideal 3D audio experience.

SUMMARY OF THE INVENTION

The present invention provides a method and a system that provide one or more localized crosstalk-canceled zones for 3D audio reproduction. It is an objective of the present invention that such method and system can be applied to small audio reproduction environments such as home, as well as large scale audio reproduction environments such as indoor and outdoor theatres such that multiple audiences can experience the same ideal 3D sound effect in different location of the theatre.

In accordance to one aspect, one or more transducers separate from the primary transducers are used to generate standalone XTC sound signals that are synchronized with the primary sound signals generated from the primary transducers when reaching the listener's ears.

In accordance to one embodiment of the present invention, provided is a realistic 3D sound reproduction using close-proximity-transducers (CPTs) associated to each listener that allows multiple crosstalk cancellation zones in a stereo sound reproduction environment. The CPTs are XTC soundwave-generating transducers that are specifically made compact transducer that the listener wears near or suspended over her ears (one transducer for each ear) and arranged in a way that does not impede the listener listening to the primary sound from the primary transducers in the stereo sound reproduction environment. In this stereo sound reproduction environment, listeners can receive ipsilateral channel of a stereo signal freely, such to experience a realistic 3D audio scene. Optionally, as the CPTs are wore on the listener, the listener's position can be tracked during playback. This way, the response of the system can be measured continuously and the XTC soundwaves can be adjusted accordingly. As such, the listener is not required to be fixed and stationary throughout the audio reproduction.

In accordance to one embodiment, provided is a system of crosstalk cancelled zone creation in audio playback that comprises two or more main transducers emitting stereo soundwaves of an audio playback; a local system comprising at least one or more CPTs configured proximal to both left and right-side ear canals of a listener, wherein each of the CPTs comprises: a position tracking device tracking the relative positions of main transducers to the CPT and other CPTs; a control unit for receiving the relative position data from the position tracking device; wherein the control unit is configured to process the relative position data and cause the CPT to generate the XTC soundwaves corresponding to the stereo soundwaves arriving at the corresponding listener's ear; wherein the XTC soundwaves generated is synchronized with the audio playback and with respect to the relative position.

In accordance to one embodiment, the position tracking device further tracks the relative position of other local systems; that the position tracking device adopts one or more wireless communication technologies and standards including, but not limited to, Bluetooth and WiFi, and specifically the associated signal triangulation techniques in tracking the relative positions; that the control unit additionally causes the CPT to emit correction signals; and that the CPT set is installed or integrated in furniture.

In accordance to an alternative embodiment, one or more of the CPT is connected to a microphone that is placed near the corresponding listener's ear. The microphone is configured to receive and measure the soundwaves of the audio playback and generate the measurement data input signal for the CPT's control unit. This configuration may optionally replace the position tracking device and the use of the relative position data in the processing and generation of the XTC soundwaves.

BRIEF DESCRIPTION OF DRAWINGS

Embodiments of the invention are described in more detail hereinafter with reference to the drawings, in which.

DETAILED DESCRIPTION

In the following description, systems and methods for creating crosstalk cancelled zones in audio playback and the likes are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

The present invention provides a method and a system that provide one or more localized crosstalk-canceled zones (LXCZ) for 3D audio reproduction. It is an objective of the present invention that such method and system can be applied to small audio reproduction environments such as home, as well as large scale audio reproduction environments such as indoor and outdoor theatres such that multiple audiences can experience the same ideal 3D sound effect in different location of the theatre.

Figure 4:
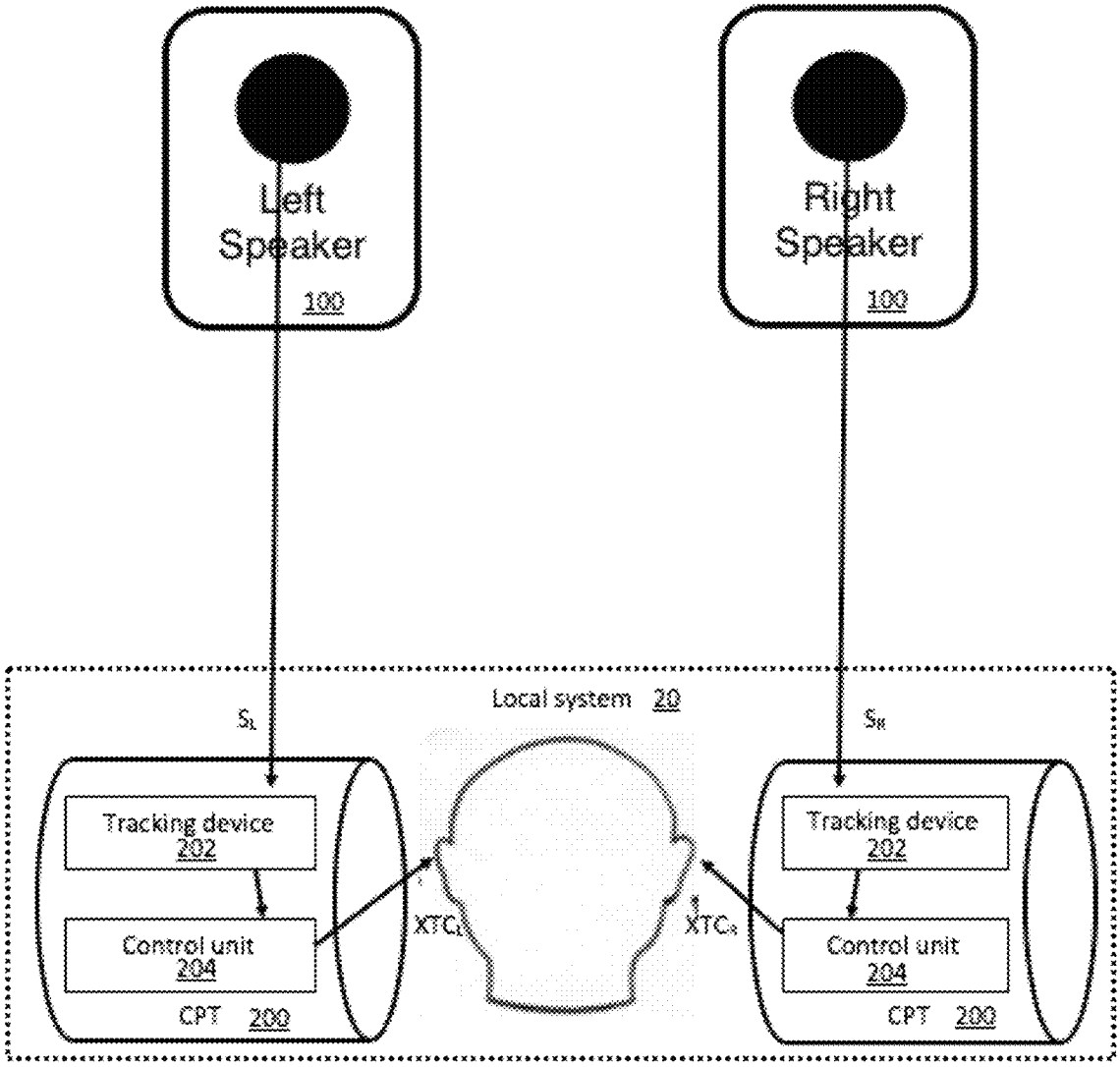
FIG. 4 illustrates the arrangement of a listener listening to an audio reproduction using two loudspeakers and two XTC transducers in accordance to one embodiment of the present invention.

In accordance to one aspect, one or more transducers separate from the primary transducers are used to generate standalone XTC sound signals that are synchronized with the primary sound signals generated from the primary transducers when reaching the listener's ears. FIG. 4 provides a simplified illustration of this concept.

In one embodiment, the XTC soundwave-generating transducers are specifically made compact transducer that the listener wears near or suspended over her ears (one transducer for each ear) and arranged in a way that does not impede the listener listening to the primary sound from the primary transducers. Optionally, as the XTC soundwave-generating transducers are wore on the listener, the listener's position can be tracked using a position tracking device embedded in the XTC soundwave-generating transducer during playback. This way, the response of the system can be measured continuously and the XTC soundwaves can be adjusted accordingly. As such, the listener is not required to be stationary throughout the audio reproduction.

In accordance to an alternative embodiment, one or more of the XTC soundwave-generating transducer is connected to a microphone that is placed near the corresponding listener's ear. The microphone is configured to receive and measure the primary sound and generate the measurement data input signal for the CPT's control unit. This configuration may optionally replace the position tracking device and the use of the position information of the listener in the processing and generation of the XTC soundwaves.

As shown in FIG. 4, a system of crosstalk cancelled zone creation in audio playback comprises two or more main transducers 100 for emitting stereo soundwaves of an audio playback; and a local system 20 having at least one or more CPTs 200 located proximal to both left and right-side ear canals of a listener. Each of the CPTs 200 comprises a position tracking device 202 for tracking the relative positions of the main transducers 100 to the CPTs 200; and a control unit 204 configured for receiving the relative position data from the position tracking device 202. The control unit 204 is configured to process the relative position data and cause the CPT 200 to generate XTC soundwaves corresponding to the stereo soundwaves arriving at the respective listener's ear. The XTC soundwaves generated is synchronized with the audio playback and with respect to the relative position.

Figure 6:
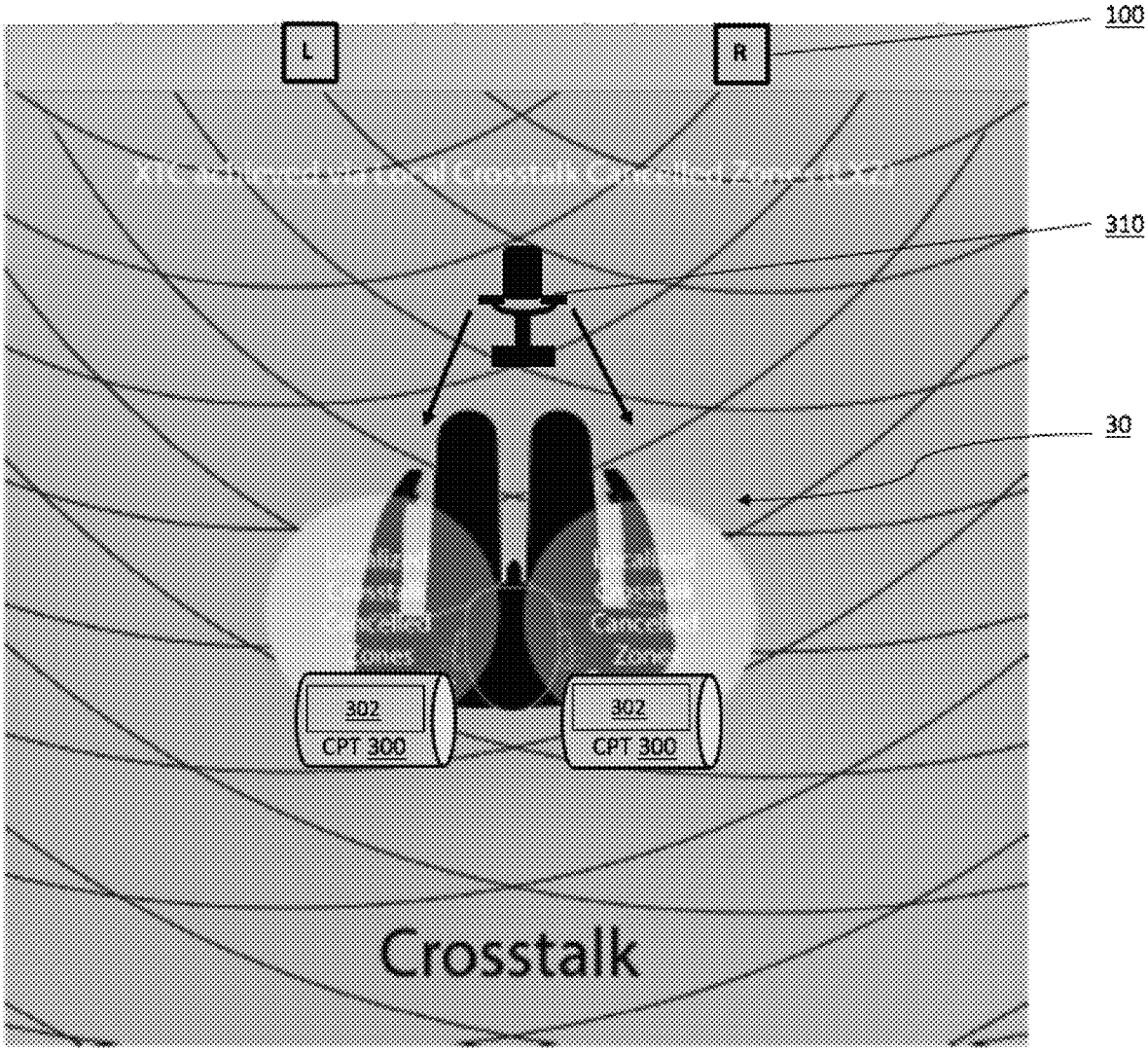
FIG. 6 provides a close-up view of the illustration of FIG. 5.

As shown in FIG. 6, a system of crosstalk cancelled zone creation in audio playback comprises one or more main transducers 100 emitting stereo soundwaves of an audio playback; and a local system 30. The local system 30 comprises at least two or more close-proximity-transducers (CPTs) 300 and one or more microphones 310. Each of the CPTs 300 is arranged to locate proximal to one of left and right-side ear canals of the listener. Each of the microphones 310 is placed proximal to a listener's ears and configured to receive and measure the stereo soundwaves of the audio playback. The microphone 310 generates a measurement data indicating the relative positions of the main transducers 100 to the left and right-side ear canals of the listener. Each of the CPTs 300 comprises a control unit 302 configured for receiving measurement data of the stereo soundwaves of the audio playback from the microphones 310 and generating control signal according to the measurement data for the generation of XTC soundwaves. Each of the CPTs 300 is configured to generate XTC soundwaves corresponding to the stereo soundwaves arriving at the corresponding ear of the listener; and the generated XTC soundwaves are synchronized with the audio playback and with respect to the relative positions.

In the following, the various systems and methods of present invention are described by mathematical formulae, where ideal localized crosstalk cancellation zone creation and the relationships are defined.

Fundamental Formulation of the System

Consider an acoustic environment $\Omega$ containing n local systems $Q_j$, $1 \le j \le n$ and m point acoustic sources $S_i$, $1 \le i \le m$, where both i and j are integers equal to or greater than 1.

The acoustic environment $\Omega$ can be either a closed room or an open space with different walling and environmental structures. Each local system $Q_j$ comprises: a set of receivers, wherein the position of k-th receiver of the system $Q_j$ is by $\vec{r}_{jk}^{(rec)}(t)$ at time t, and wherein examples of receivers include the listener's ears and microphones; a set of local proximity transducers (CPT) that emit a local sound field, wherein the position of l-th transducer of the system $Q_j$ is by $\vec{r}_{jl}^{(tr)}(t)$ at time t, and wherein examples of transducers include over-ear, on-ear, and in-ear headphones, ear-buds, other types of wearable speakers, fixed and portable loudspeakers.

All acoustic sources $S_i$, $1 \le i \le m$, produce an acoustic field $p(\vec{r}, t)$, $\vec{r} \in \Omega$. The acoustic pressure signal at the position of the k-th receivers of the system $Q_j$ is $p_{jk}(t) = p(\vec{r}_{jk}^{(rec)}(t), t)$. The acoustic pressure signals $p_{jk}(t)$ for the different values of k will determine the acoustic experience (in the case of a human user) reproduced by the system $Q_j$. The realistic 3D sound reproduction defined as a set of target signals $\tilde{p}_{jk}(t)$ is to be received by the receiver. The target signals $\tilde{p}_{jk}(t)$ can also be defined as the acoustic pressure signals received in a referential situation (e.g. a concert hall) that are emulated with the audio sources $S_i$. The target signals $\tilde{p}_{jk}(t)$ can represent a real acoustic environment (e.g. listening to a live orchestra in the concert hall), or manipulated audio (e.g. real recordings with modified or added features) or completely artificial sound. Thus, the differences between the target signals $\tilde{p}_{jk}(t)$ and the acoustic pressure signals $p_{jk}(t)$ are the correction signals $\Delta p_{jk}(t)$ which is represented by:

$$\Delta p_{jk}(t) = \tilde{p}_{jk}(t) - p_{jk}(t)$$

The correction signals are obtained by means of the CPTs. The l-th CPT associated to the system $Q_j$ emit a signal $x_{jl}(t)$ such that the correction signal $\Delta p_{jk}(t)$ is received at the k-th receiver.

Configuration Parameters

The signals $x_{jl}(t)$ emitted by the CPTs generally depend on the relative position, represented by $\vec{r}_{jk}^{(rec)}(t) - \vec{r}_{jl}^{(tr)}(t)$, of the receiver with respect to the transducers and the acoustic properties of the environment, including the positions of other systems and the component body of the current system. All quantities are time-dependent. For these reasons, each system $Q_j$ computes a vector $q_j(t)$ of the time-dependent internal variables in order to compute the signals $x_{jl}(t)$ to be emitted. These variables includes: the degree of freedom describing the spatial configuration of the body of the system $Q_j$; other internal parameters of the system, for example, in a time-independent framework for human users, the Head Related Transfer Function (HRTF); and environmental data that influence the propagation of sound from the audio sources $S_i$ as, in a time-independent framework, the environmental transfer functions. These variables enable the reconstruction of at least the relative positions $\vec{r}_{jk}^{(rec)}(t) - \vec{r}_{jl}^{(tr)}(t)$ of the listener with respect to the transducers. The data collected by the sensors associated with the system enable the real time computation of the vector $q_j(t)$.

Generation of the Correction Signals

Each local system $Q_j$ is associated with a multiple-input and multiple-output (MIMO) linear time-variant system (LTV) $L_j$ that computes the output signal $x_{jl}(t)$ of the corresponding transducers needed to obtain the desired correction signals $\Delta p_{jk}(t)$. Time variance is required as the system works in time-varying conditions. Hence, the input and output signals of the LTV L are the correction signals $\Delta p_{jk}(t)$ and the signals $x_{jl}(t)$ to be generated by the transducers respectively. Here, the indexes k and l run over the set of receiver (listener(s)' ear(s)) and the set of transducers respectively of a single system $Q_j$. If a multichannel signal $\Delta p_j(t)$ with one channel for each listener j and a multichannel signal $x_j(t)$ with one channel for each listener j, the functional relation between input and output can be described as:

$$x_j(t) = L_j[\Delta p_j(t); q_j(t)]$$

where $q_j(t)$ is the vector of the time-dependent parameters defined above.

Locality of the Cancellation Process

The functional relation defined above, together with the restrictions on the parameters $q_j(t)$ described, imply that the process is local. This means the target signal $\tilde{p}_{jk}(t)$ imposed disregards the crosstalk produced by the correction signals of a local system from other local systems. Here, the term local means that each local system $Q_j$ makes decisions about the cancellation signals to be sent independently from other local systems. This enables the design of independent LTV for each subsystem. Optionally, the LTVs can include additional system to detect inter-users disturbances when needed, which can then be attenuated.

In one embodiment, a set of sensors can be included in a local system $Q_j$. For example, sensors for tracking the head movement for adjusting the HRTF, and the surrounding environment including the positions of other local systems that approaching or leaving away such that preloaded inter-user disturbance attenuation can be applied in advance.

Figure 5:
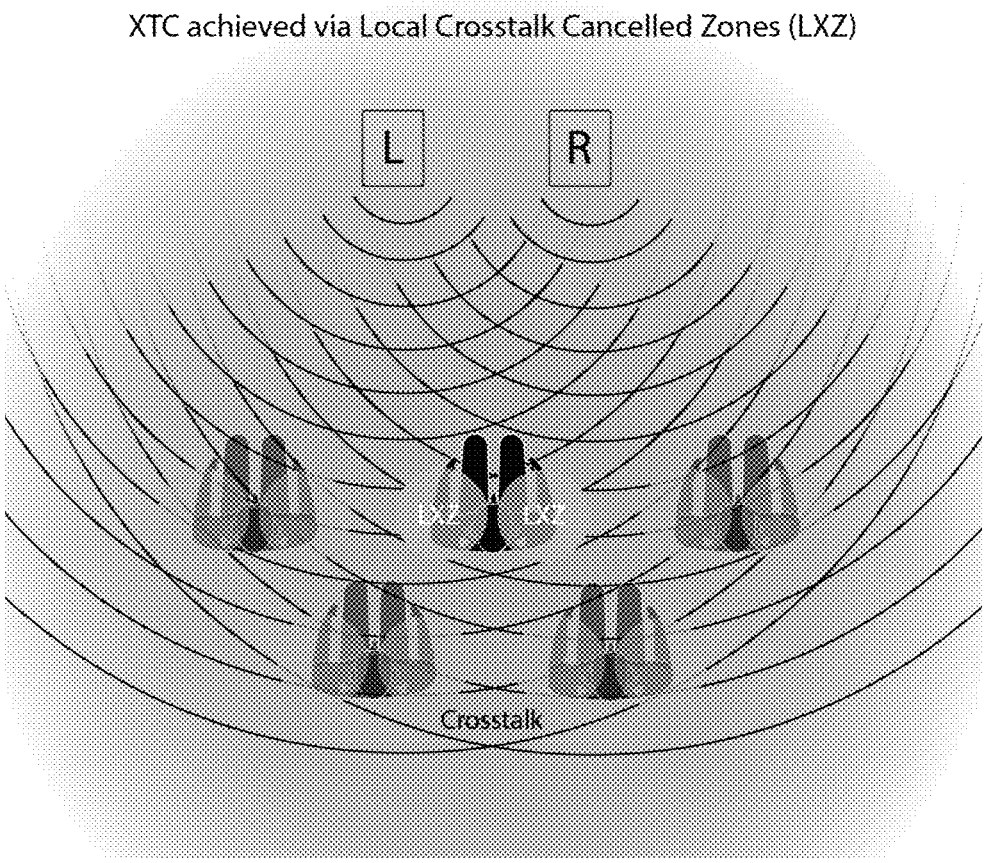
FIG. 5 provides an illustration of the localized XTC zones.

In accordance to one embodiment, a separate pair of transducers (close-proximity-transducers (CPTs)) is provided and located in close proximity to the listener. The primary acoustic source remains to be a pair of main external stereo loudspeakers in front of the listeners, with the CPTs providing the crosstalk-cancelling signals. The use of CPTs to perform XTC is to provide listeners with their individualized XTC zones/bubbles. FIG. 5 provides an illustration of the individualized XTC zones/bubbles, and FIG. 6 provides its close-up view.

The CPTs provide the XTC soundwaves to cancel the crosstalk coming from the main external speakers. This allows the listeners to have a much higher degree of freedom in terms of movement. Not only will each individual have freedom of movement, but since CPTs are individual based or localized, there can be many listeners sharing the same listening experience from the same set of main speakers.

The CPTs of a system could produce inter-user crosstalk towards other systems. This may happen when CPT different from open headphones are used while users come too close. The definition of correction signal aforesaid does not include such non-significant effects in general. Optionally, the CPTs may comprise additional functions to handle such inter-user disturbances.

Optionally, the XTC soundwaves generated by the CPTs include coloration reduction, equalization, and/or user presets of sound effects.

In accordance to another embodiment, the CPTs can be a pair of open-back headphones (where external sound can travel through reaching the listener's ears), or a pair of headphones like the Sony PFR-V1 or the Bose Soundwear. The CPTs, however, are not limited to wearables. For example, in a movie theater application, it may be possible to embed CPTs into the headrest of the chairs. The advantage of having CPTs as wearables is that the physical relationship between the CPT and the listener can be fixed, but it is also possible to embed CPTs into headrests, all subject to the tolerance level of the algorithm for computing the crosstalk-cancelling signals.

The location of the listeners in relation with the main speakers will have an impact on the effectiveness of the level of XTC achieved. Various technologies can be implemented to determine the location of the listeners. For example, Bluetooth based triangulation technology can be used to determine the location. Other wireless technologies can also provide very accurate positioning information. The positioning information can be used to calculate the delay required for the L and R channels of the CPTs.

CPTs can be wired or wireless devices. The main goal here is to separate the XTC zone from a traditional BAL setup from the main speakers. Instead, we create local XTC zones for each individual.

Figure 1:
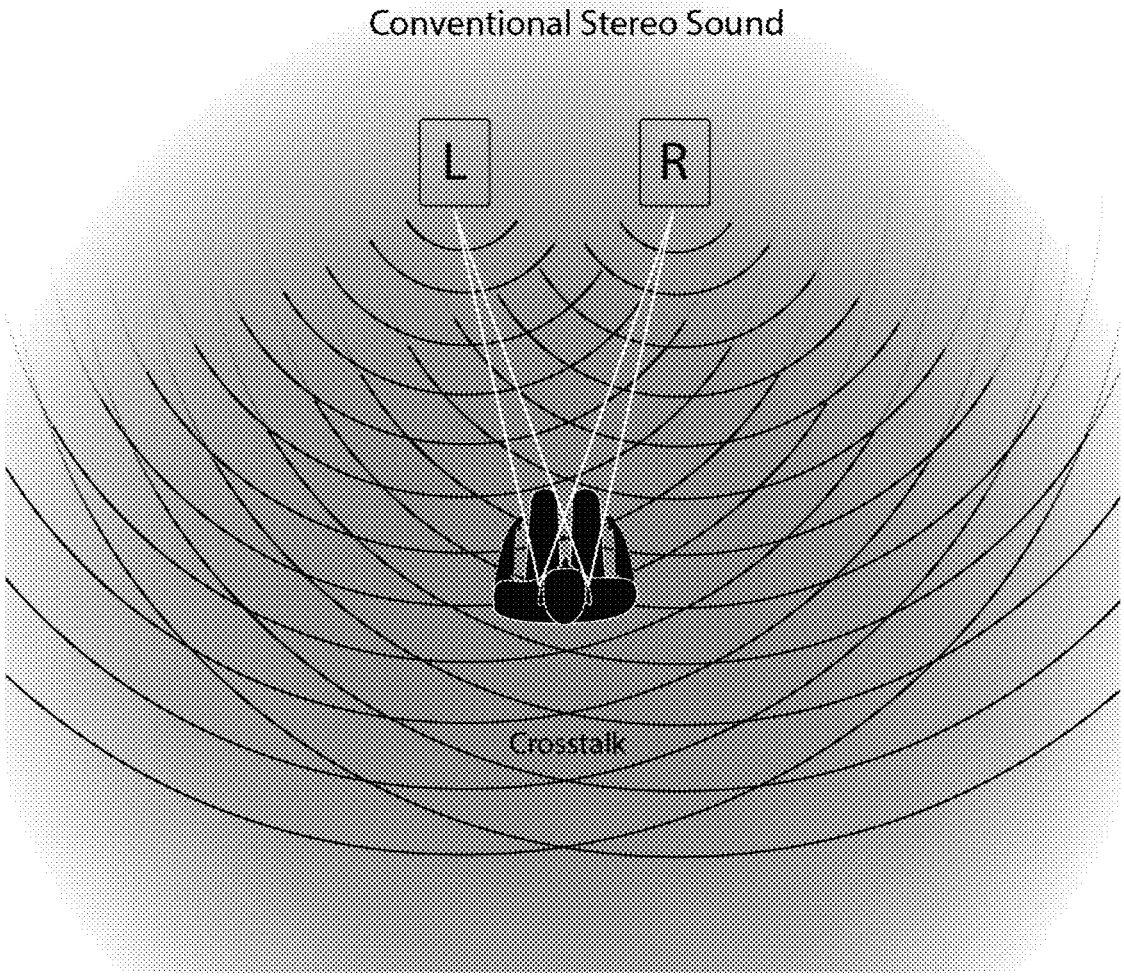
FIG. 1 illustrates the condition of a listener listening conventional stereo audio reproduced using two loudspeakers without XTC.
Figure 2:
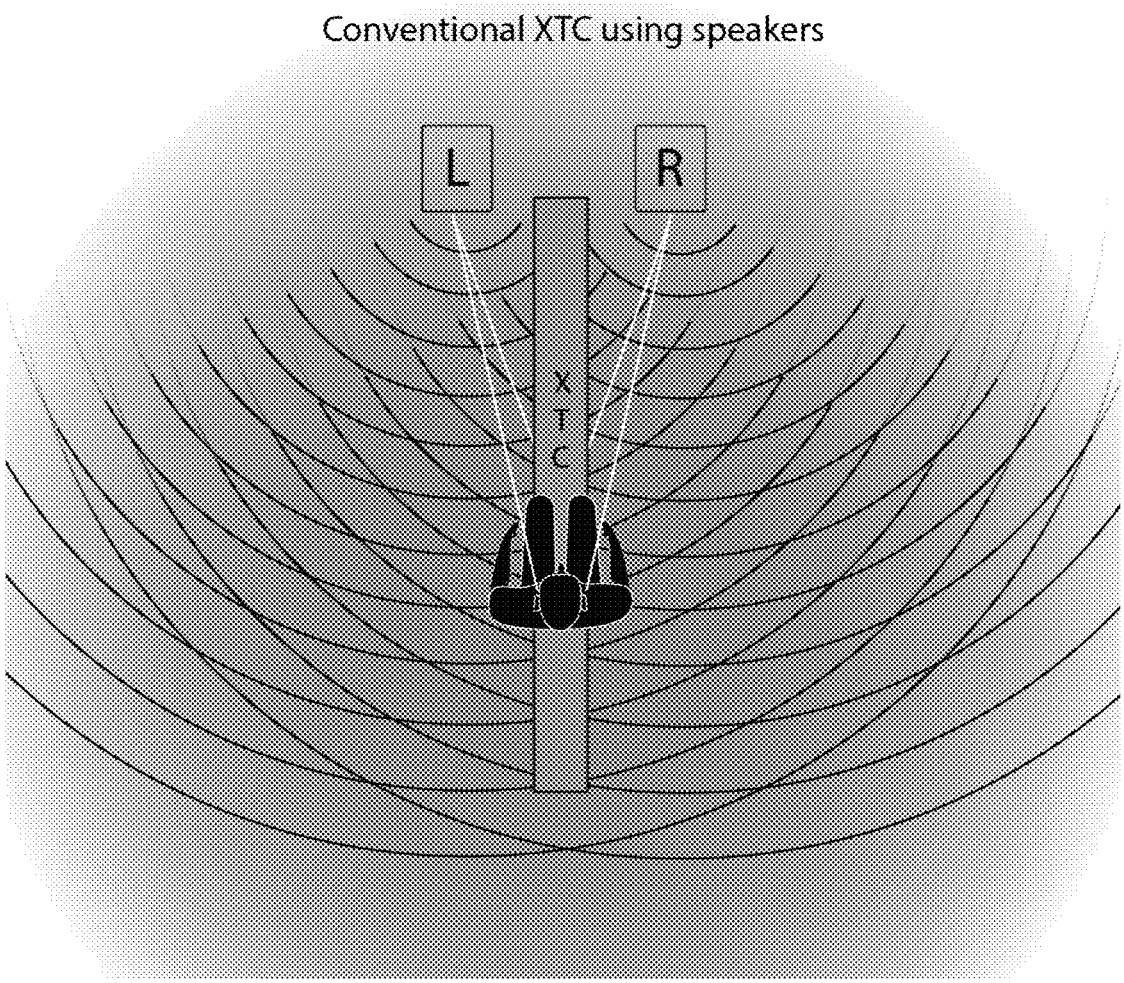
FIG. 2 illustrates the condition of a listener listening conventional XTC audio reproduced using two loudspeakers.
Figure 3:
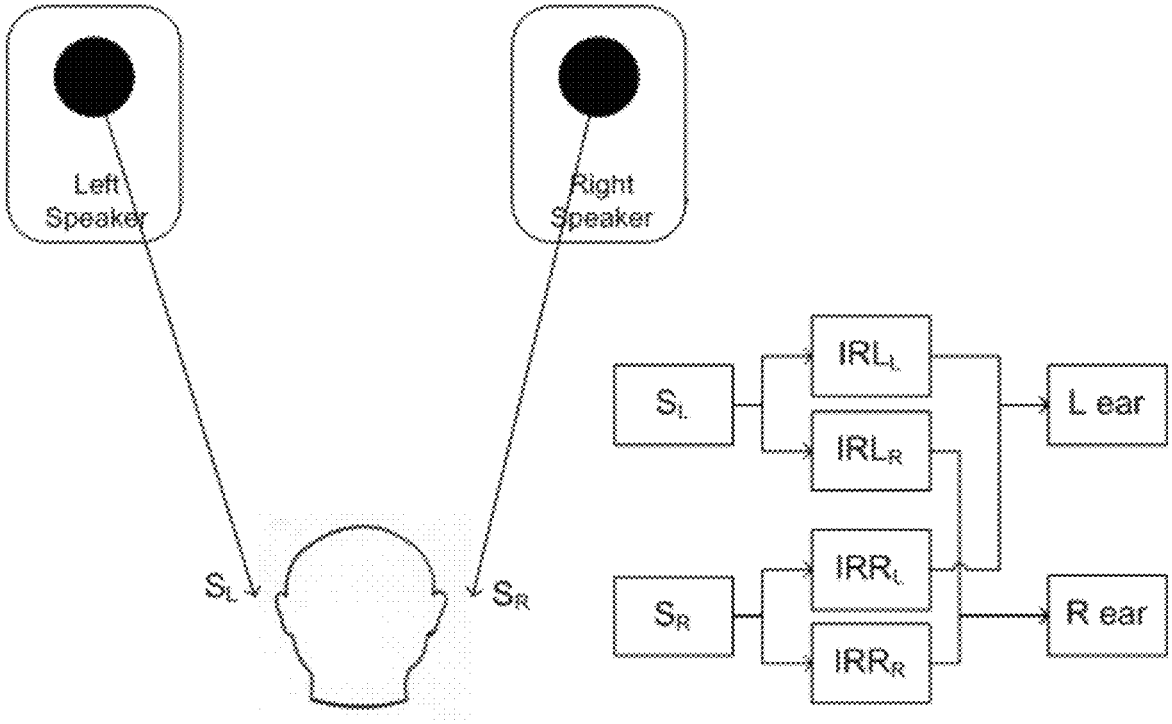
FIG. 3 depicts an exemplary embodiment of a conventional audio system with XTC filter.
Figure 7:
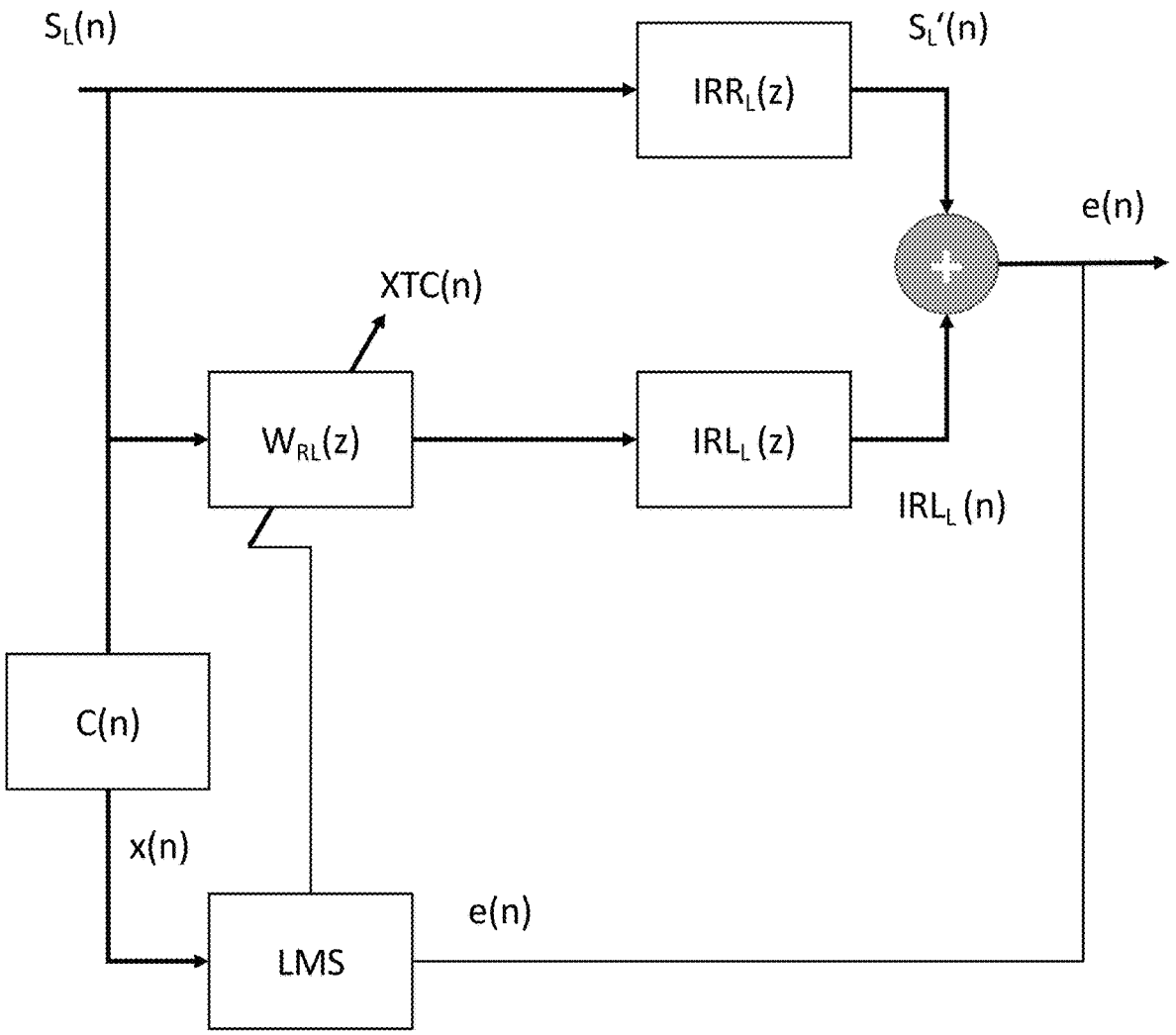
FIG. 7 depicts a block diagram of the XTC filter estimation using FxLMS algorithm.

Referring to FIGS. 3 and 7. FIG. 7 depicts a block diagram of the XTC filter estimation using the Filtered Least Mean Squared (FxLMS) algorithm. To better illustrate, the description of this embodiment focuses mainly on implementing crosstalk cancellation for the left ear. However, an ordinarily-skilled person in the art will appreciate that the same can be applied to the right ear of the listener.

In this embodiment, as shown in FIG. 7, an XTC filter $W_{RL}(Z)$ is introduced as a linear filter with coefficients adjusted based on the FxLMS algorithm. $S_L(n)$ is the stereo soundwaves of an audio playback from the main transducers. $IRR_L(z)$ and $IRL_L(z)$ are transfer functions processing the $IRR_L(n)$ and $IRL_L(n)$ signals. $IRR_L(n)$ can be considered as a noise signal that is emitting from the right (R) main transducer in FxLMS algorithm. $IRL_L(n)$ is considered as a compensating signal that is emitting from the left (L) main transducer in FxLMS algorithm. The XTC soundwaves XTC(n) is obtained by filtering the stereo soundwaves $S_L(n)$ with the XTC filter $W_{RL}$ (z), and can be described as $$XTC(n)=S_L^T(n)W_{RL}(n);$$

where the weight vector of the XTC filter $W_{RL}$ (z) at time n is defined as $W_{RL}(n)=[W_{RL0}(n), W_{RL1}(n), \ldots, W_{RLNw-1}(n),]^T$, and Nw is the filter tap-length; and $$S_L(n)=[S_L(n),S_L(n-1), \ldots ,S_L(n-Nm+1)]^T.$$

The error signal e(n) is observed by the sensor of L CPT and is defined as $$e(n)=S_L^n+(XTC'(n)*IRL_L(n));$$

where XTC'(n) is $[XTC'(n), XTC'(n-1), \ldots, XTC'(n-M+1)]^T$, $IRL_L(n)$ is the impulse response of $IRL_L(z)$, and $IRL_L(n)=[IRL_{L0}, IRL_{L1}, \ldots W_{RL}(n)]^T$ within the length of $IRL_L(z)$.

The error signal e(n) needs to be minimized by updating the weight vector of the XTC filter $W_{RL}(Z)$ using the FxLMS algorithm to achieve the crosstalk cancellation at the location of the CPT. The update algorithm can be defined as:

$$W_{RL}(n+1)=WRL(n)-\mu x(n)e(n);$$

where $x(n)=[x(n), x(n-1), \ldots]^T$ within the length of $IRL_L(z)$, and p denotes the step size that determines the convergence of the algorithm.

x(n) is the filtered version of the stereo soundwaves $S_L(n)$, and can be defined as:

$$x(n)=S_L^T(n),c(n).$$

Once the error signal e(n) converges, the final XTC filter $W_{RL}(Z)$ will be used to estimate cancellation signal. As the $IRR_L(z)$ signal is being cancelled from the R transducer, C(n) can be considered as the impulse response of $IRL_L(z)$. $C(n)=IRL_L(n)$.

It is noted that since the CPT of the present invention comprises a position tracking device (or a microphone sensing the stereo soundwaves) for tracking the relative positions of the main transducers to the CPT, the $IRR_L(n)$ and $IRL_L(n)$ can easily be measured and calculated according to the information of the relative positions between the main transducers and the CPT.

Figure 8:
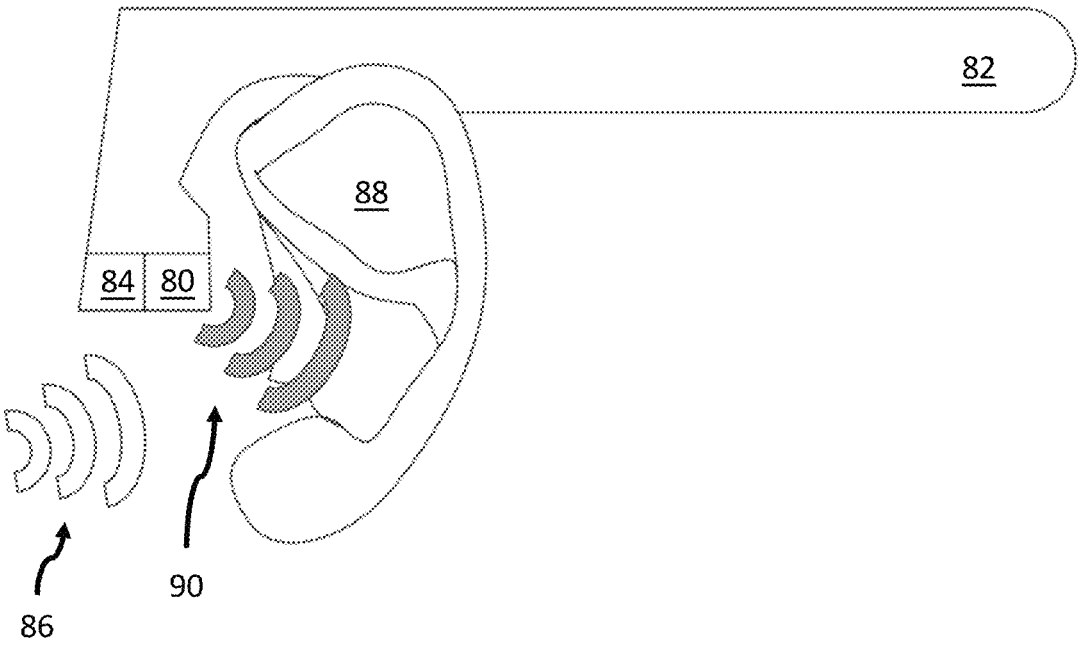
FIG. 8 depicts a schematic diagram illustrating a CPT in accordance with an embodiment of the present invention.

Referring to FIG. 8. In accordance to one embodiment, the construction of a CPT resembles that of a wearable open ear headphone. The CPT comprising two speakers 80 respectively arranged at two ends of a surrounding body 82, and two microphone 84. The speaker 80 is arranged closely to the listener's ear 88, and generates XTC soundwaves 90 toward the ear canal. The microphone 84 is disposed adjacent to the speaker 80, and is configured to receive and measure the stereo soundwaves 86 of the audio playback from the main transducers. In other embodiments, the CPT may be integrated into a pair of spectacles, 3D viewing glasses, a virtual reality goggle, a wearable gear fixed around the listener's head or neck, or on shoulders.

Compared to over-ear, on-ear, and in-ear headphones, and ear-buds, the open-ear headphone design of this CPT specifically allows the stereo soundwaves 86 of the audio playback from the main transducers to reach the listener's ears unobstructed.

Although the present document describes the CPTs of the present invention as applied primarily to headphones, an ordinarily skilled person in the art will be able adapt its various embodiments to be applied to other types of proximity devices such as, without limitation, embeddable devices to stationary objects, for example a chair, a sofa, a neck cushion, head gear, or any other wearable device without undue experimentation.

The embodiments disclosed herein may be implemented using general purpose or specialized computing devices, mobile communication devices, computer processors, or electronic circuitries including but not limited to digital signal processors (DSP), application specific integrated circuits (ASIC), field programmable gate arrays (FPGA), and other programmable logic devices configured or programmed according to the teachings of the present disclosure. Computer instructions or software codes running in the general purpose or specialized computing devices, mobile communication devices, computer processors, or programmable logic devices can readily be prepared by practitioners skilled in the software or electronic art based on the teachings of the present disclosure.

In some embodiments, the present invention includes computer storage media having computer instructions or software codes stored therein which can be used to program computers or microprocessors to perform any of the processes of the present invention. The storage media can include, but are not limited to, floppy disks, optical discs, Blu-ray Disc, DVD, CD-ROMs, and magneto-optical disks, ROMs, RAMs, flash memory devices, or any type of media or devices suitable for storing instructions, codes, and/or data.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A system of crosstalk cancelled zone creation in audio playback comprising:

one or more main transducers emitting stereo soundwaves of an audio playback;

a local system comprising:

at least two or more close-proximity-transducers (CPTs), wherein each of the CPTs is arranged proximal to one of left and right-side ear of a listener;

a position tracking device for tracking the relative positions of the main transducers to the CPT and the other CPTs; and a control unit for receiving the relative position data from the position tracking device and generating control signal to adjust a crosstalk cancellation (XTC) filter according to the relative position data for filtering the stereo soundwaves;

wherein each of the CPTs is configured to generate XTC soundwaves corresponding to the filtered stereo soundwaves; and wherein the generated XTC soundwaves are synchronized with the audio playback and with respect to the relative positions.

2. The system of claim 1, wherein the position tracking device further tracks the relative position of other local systems.

3. The system of claim 1, wherein the position tracking device includes wireless communication triangulation device for tracking the relative positions.

4. The system of claim 1, wherein the CPTs include one or more of open-ear headphones.

5. The system of claim 1, wherein the CPTs are integrated into a pair of spectacles, 3D viewing glasses, or a virtual reality goggle.

6. The system as claimed in claim 1, wherein the XTC filter is a linear filter using Filtered Least mean squared (FxLMS) algorithm.

7. A system of crosstalk cancelled zone creation in audio playback comprising:

one or more main transducers emitting stereo soundwaves of an audio playback;

a local system comprising:

at least two or more close-proximity-transducers (CPTs), wherein each of the CPTs is arranged proximal to one of left and right-side ear of the listener;

one or more microphones, wherein each of the microphones is placed proximal to a listener's ears and configured to receive and measure the stereo soundwaves of the audio playback to generate a measurement data indicating a relative position of the main transducers to the listener's ears;

a control unit for receiving measurement data of the stereo soundwaves of the audio playback from the microphones and generating control signal to adjust a crosstalk cancellation (XTC) filter according to the measurement data for filtering the stereo soundwaves;

wherein each of the CPTs is configured to generate XTC soundwaves corresponding to the filtered stereo soundwaves; and wherein the generated XTC soundwaves are synchronized with the audio playback and with respect to the relative positions.

8. The system of claim 7, wherein the CPTs include one or more of open-ear headphones.

9. The system of claim 7, wherein the CPTs are integrated into a pair of spectacles, 3D viewing glasses, or a virtual reality goggle.

10. The system as claimed in claim 7, wherein the XTC filter is a linear filter using Filtered Least mean squared (FxLMS) algorithm.

* * * * *